United States Patent [19]

Gause

[11] 3,942,540

[45] Mar. 9, 1976

[54] HAIRBRUSH WITH RETRACTABLE HANDLE AND MIRROR

[76] Inventor: Lawrence J. Gause, 2019 Lacey St., Bakersfield, Calif. 93304

[22] Filed: Oct. 3, 1974

[21] Appl. No.: 511,700

[52] U.S. Cl. ..... 132/85; 15/144 B; 132/79 G

[51] Int. Cl.[2] ..... A45D 44/18

[58] Field of Search ..... 132/79, 102, 83, 85; 32/69; 128/3; 88/47; 15/144 B, 184

[56] References Cited

UNITED STATES PATENTS

| | | | |
|---|---|---|---|
| 287,187 | 10/1883 | Stanton | 15/144 B |
| 497,451 | 5/1893 | Kintner | 132/85 |
| 1,243,896 | 10/1917 | Szuhay | 132/85 |
| 1,388,955 | 8/1921 | Kozlowsky et al. | 132/119 |
| 2,796,070 | 6/1957 | Marsak | 132/85 |
| 3,059,259 | 10/1962 | Peilet et al. | 15/184 |

FOREIGN PATENTS OR APPLICATIONS

| | | | |
|---|---|---|---|
| 206,062 | 11/1923 | United Kingdom | 15/144 |

*Primary Examiner*—G. E. McNeill
*Attorney, Agent, or Firm*—Clarence A. O'Brien & Harvey B. Jacobson

[57] ABSTRACT

A hair grooming brush having a body from which a mirror and handle are extended in perpendicular relationship to each other upon actuation of a release button. The mirror and handle are retained retracted within cavities formed in the brush body by latches and are projected to the extended positions under the bias of springs.

6 Claims, 10 Drawing Figures

HAIRBRUSH WITH RETRACTABLE HANDLE AND MIRROR

This invention relates to a hair grooming device and more particularly to a hairbrush which features a mirror and grip handle associated therewith.

Hair grooming devices or brushes having extensible and retractable handles are well known as disclosed for example in U.S. Pat. Nos. 2,173,437 and 3,690,331. A hair grooming brush having a body within which a mirror is retained, is also known as disclosed in U.S. Pat. No. 1,632,392. The foregoing prior art grooming devices are designed to provide additional convenience to the user but have several drawbacks and disadvantages. The mere storage of grooming articles in a hairbrush body such as mirrors or combs, does not provide any lasting convenience because of the loss of such articles when removed from the brush body. Further, the prior art fails to disclose any coordination between an extensible handle and an extended mirror for use while the hairbrush is being utilized. It is therefore an important object of the present invention to provide a hair grooming brush from which a grip handle and mirror are simultaneously projected to extended positions without disconnection from the brush body in order to assist the user in both manipulating the hairbrush and visually monitoring its effect on the hair.

In accordance with the present invention, a hairbrush body is provided with cavities within which a grip handle and mirror are held in retracted positions by latch devices that are released in response to slidable displacement of a release button. The handle and mirror are projected to the extended positions by springs that remain protectively enclosed within the brush body. The handle and mirror in the extended positions are disposed in perpendicular relationship to each other so as not to interfere with each other while the mirror is disposed in a plane generally parallel to the face of the brush body from which the brush bristles extend. A person utilizing the hairbrush may accordingly monitor its effect on the hair by use of the hairbrush extended mirror and the usual grooming mirror.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 2:
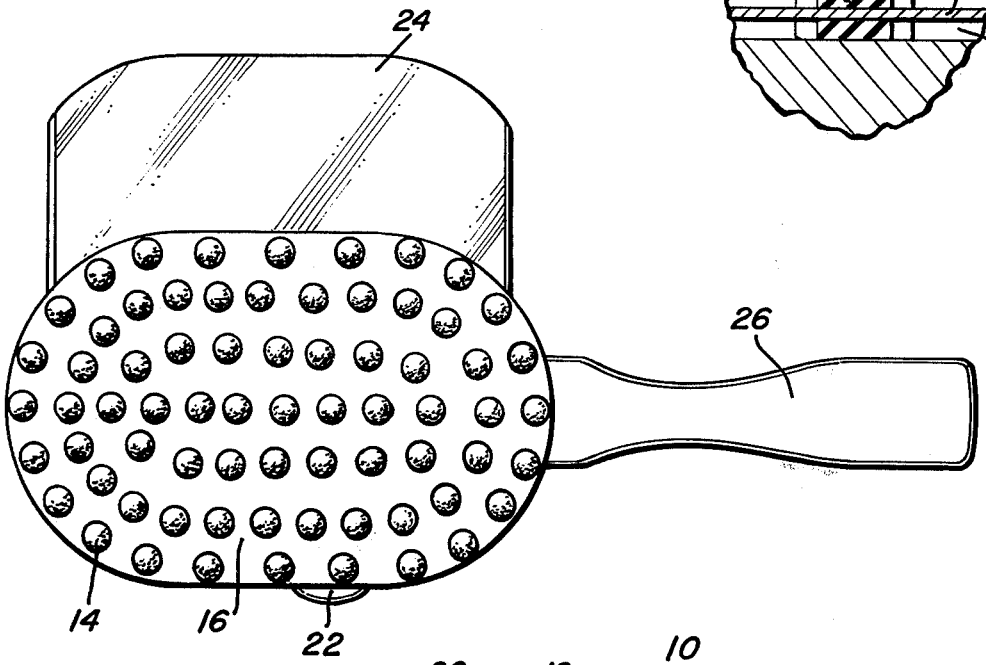
FIG. 2 is a bottom elevational view of the hair brush shown in FIG. 1.
Figure 3:
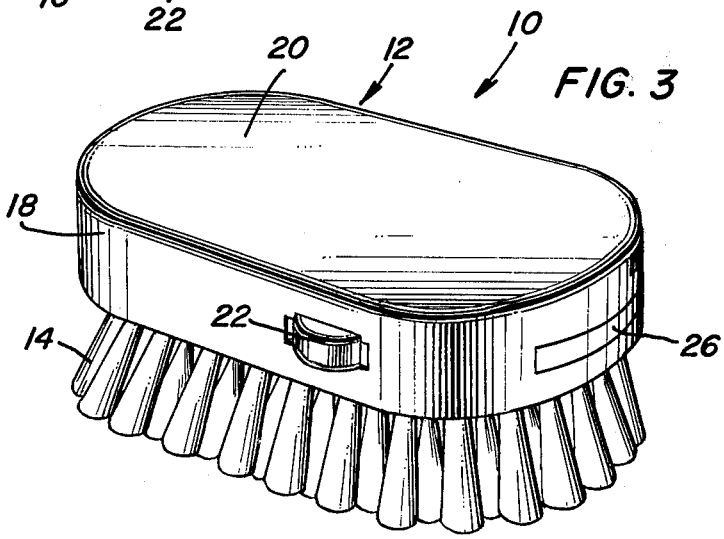
FIG. 3 is a perspective view of the hairbrush shown in FIGS. 1 and 2 but with the grip handle and mirror retracted.

Referring now to the drawings in detail, FIG. 3 illustrates what may appear to be a conventional type of hair grooming brush generally referred to by reference numeral 10. The hairbrush thus includes an oblong-shaped body 12 from which a plurality of brush bristles 14 extend. The brush bristles extend from an underface 16 of the body as more clearly seen in FIG. 2. The body is also formed with an external, peripheral edge surface 18 that extends between the face 16 from which the bristles extend to a top surface 20. A slidable release button 22 extends from one longitudinal side of the edge surface 18 opposite a longitudinal side portion from which a reflector element or mirror 24 is projected to an extended position as shown in FIG. 2. Also extended from the brush body 12 from a longitudinal end portion thereof, is a grip handle 26. As shown in FIG. 2, the mirror or reflector element 24 when extended is disposed in perpendicular relationship to the grip handle element 26. when extended, the reflective surface of the mirror faces the same direction as the brush bristles 14. Accordingly, the hair grooming device 10 may be grasped in one hand by means of the grip handle 26 and manipulated over the head for hair grooming purposes in front of the usual grooming mirror. The relfector element 24 or mirror enables the person to view the back of the head as it is being groomed by the brush bristles. To store the hair grooming device 10 after use, the mirror 24 and grip handle are simply pushed into the brush body and are held completely enclosed therein as shown in FIG. 3. To release the mirror and grip handle once again, the release button 22 is simply displaced in one direction resulting in the mirror and grip handle being projected outwardly to the extended positions.

Figure 5:
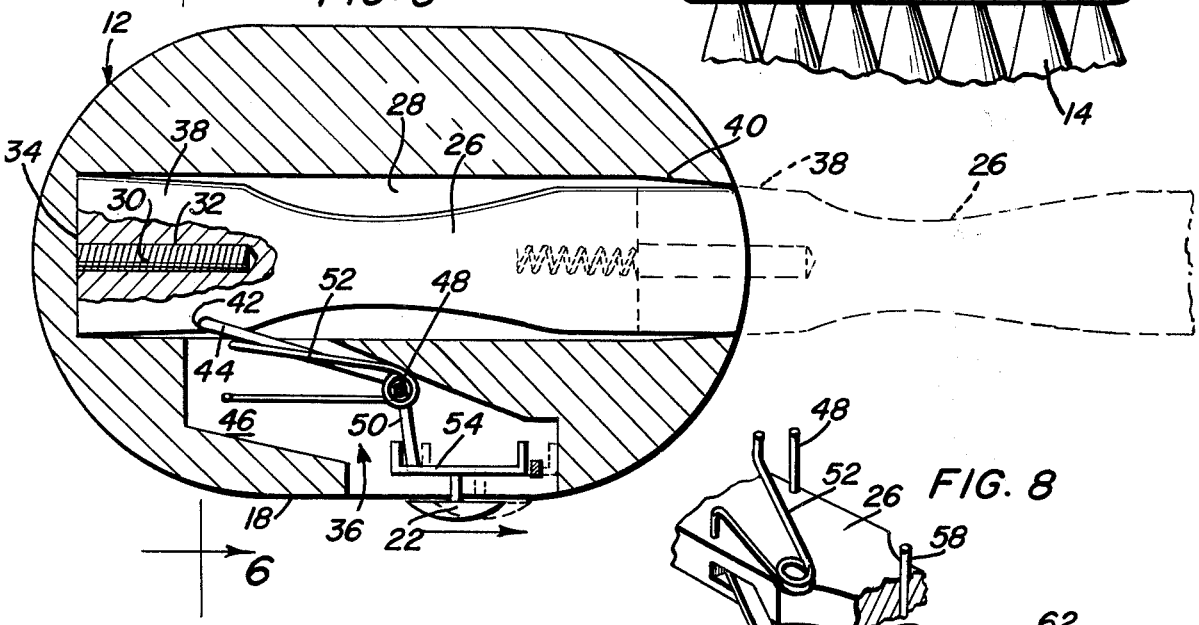
FIG. 5 is a top sectional view taken substantially through a plane indicated by section line 5—5 in FIG. 1 but with the grip handle retracted.
Figure 8:
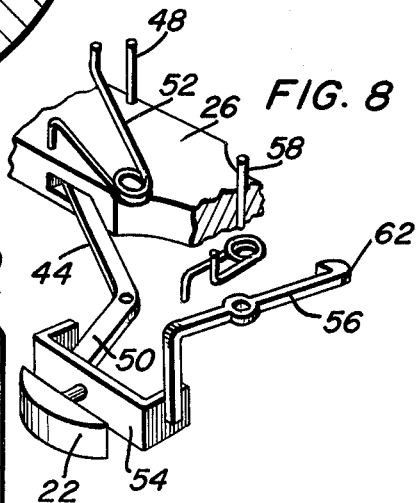
FIG. 8 is a perspective view illustrating disassembled portions of the releasable latch mechanism associated with the hair grooming device.

As more clearly seen in FIG. 5, the brush body 12 is provided with a longitudinal cavity 28 extending from one longitudinal end portion from which the grip handle is projected under the impetus of a compression spring 30 anchored to the grip handle within an end bore 32. with the grip handle retracted to the solid line position shown in FIG. 5, the end of the compression spring projecting from the bore 32 abuts the internal end wall 34 of the cavity 28, the grip handle being held in this retracted position against the bias of the spring 30 by a releasable latch mechanism generally referred to by reference numeral 36. In the extended position of the grip handle 26 as shown by dotted line in FIG. 5, its tapered end portion 38 engages the tapered end portion 40 of the cavity 28 so as to prevent detachment of the grip handle from the brush body.

The end portion 38 of the grip handle is provided with a notch 42 engageable by the latch arm 44 of the latch mechanism. The latch arm 44 projects into the cavity 28 for this purpose from a cavity 46 within the body 12 housing the latch mechanism. The latch arm 44 is pivotally mounted by a pivot pin 48 and is connected to a release arm 50. A pivot spring 52 encircles the pivot pin and is anchored at one end to the brush body, the other end bearing against the latch arm 44 in order to bias it into engagement with the grip handle. Thus, the grip handle will be retained in its retracted position against the bias of spring 30 by the latch arm 44 until released by pivotal displacement of the release arm 50 in a counterclockwise direction as viewed in FIG. 5 by means of the release button 22 to which a release element 54 is connected for slidable displacement therewith within the cavity 46. The release button is biased on one position by the spring 52 urging the latch arm into the cavity 28. Thus, when the release button 22 is displaced in a right-hand direction as viewed in FIG. 5 from the solid line positon illustrated, the latch arm 44 is withdrawn from the cavity 28 and the spring 30 then projects the grip handle toward its extended position.

Figure 4:
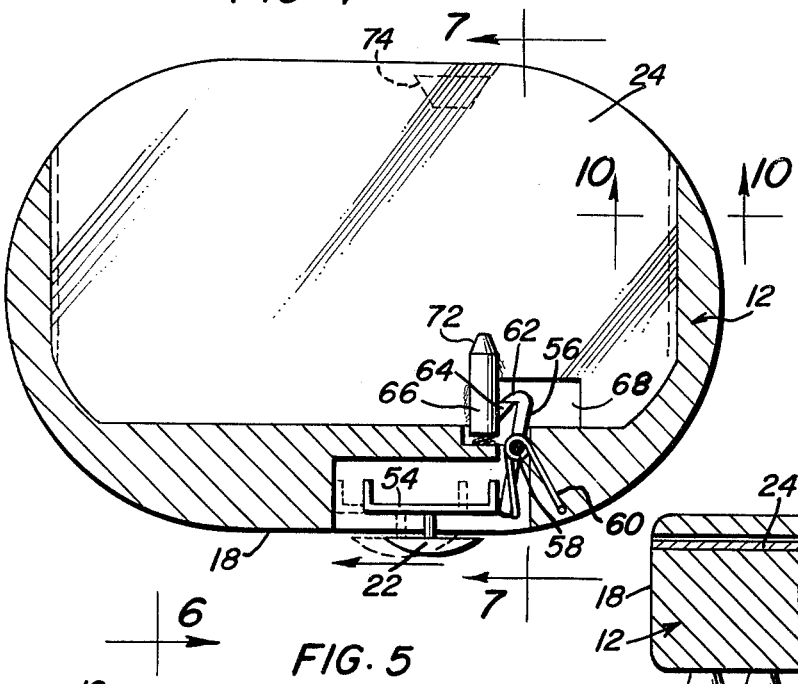
FIG. 4 is a top sectional view taken substantially through a plane indicated by section line 4—4 in FIG. 1 but with the mirror retracted.

The release element 54 connected to the release button 22, also engages the end of a latch lever 56 that is pivotally mounted by a pivot pin 58 about which a spring element 60 is retained, one end being anchored to the brush body 12, the other end bearing against the latch lever 56 tending to urge it in a clockwise direction as viewed in FIG. 4. The spring element 60 is weaker than the spring element 52 aforementioned so that it is ineffective to displace the release element 54 against the opposing bias of the spring element 52. The hook end 62 of the latch lever 56 in the position shown in FIG. 4, engages a projection 64 that extends laterally from a tubular member 66 secured as by welding to the reflector element 24. The latch lever 56 extends into a cutout 68 formed at the rear edge of the reflector element into which the projection 64 extends from the tubular member 66 in order to hold the reflector element in its retracted position within the cavity 70 formed in the brush body and extending outwardly from one longitudinal side portion opposite the release button 22. The tubular member 66 secured to the reflector element, houses a compression spring anchored therewithin. The compression spring within the tubular housing 66 thus abuts against an internal surface of the cavity 70 in the retracted position of the reflector element as shown in FIG. 4 so that when the latch lever 56 is displaced under the bias of spring 60, it is released and the spring projects the reflector element to its extended position. Release of the latch lever 56 is effected upon displacement of the release button 22 from the solid line position to the dotted line position as shown in FIG. 4. Projection of the reflector element to the extended position therefore occurs simultaneously with the projection of the grip handle to its extended position.

Figure 1:
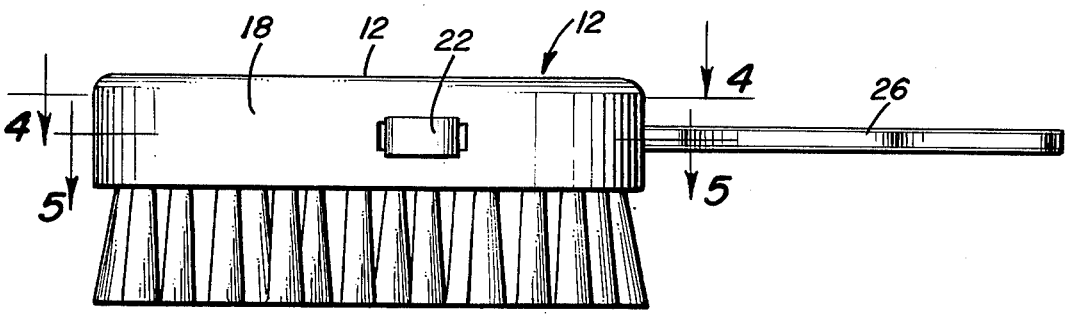
FIG. 1 is a side elevational veiw of a hair grooming brush constructed in accordance with the present invention.
Figure 9:
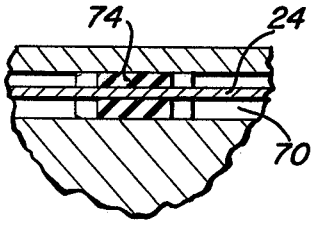
FIG. 9 is a partial sectional view taken substantially through a plane indicated by section line 9—9 in FIG. 7.
Figure 10:
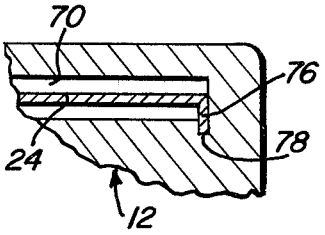
FIG. 10 is a partial sectional view taken substantially through a plane indicated by section line 10—10 in FIG. 4.
Figure 6:
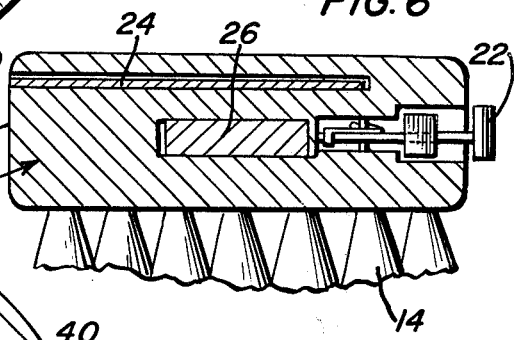
FIG. 6 is a transverse sectional view taken substantially through a plane indicated by section line 6—6 in FIG. 5.
Figure 7:
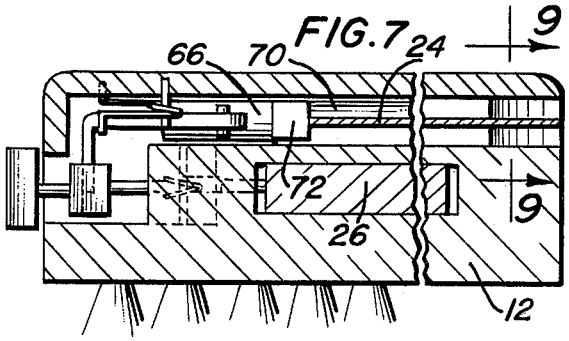
FIG. 7 is a transverse sectional view taken substantially through a plane indicated by section line 7—7 in FIG. 4.

The mirror or reflector element is prevented from becoming detached from the brush body by a tapered formation 72 engaging a tapered stop 74 mounted adjacent the longitudinal side portion of the brush body from which the reflector element is extended as more clearly seen in FIGS. 7 and 9. Movement of the reflector element 24 between its retracted and extended positions is guided by side flanges 76 formed on the reflector element and slidably received within track grooves 78 formed within the brush body 12 as more clearly seen in FIG. 10.

It will be apparent from the foregoing description that by simply pushing the release button 22, both the grip handle and reflector elements are slidably displaced to the extended positions without detachment from the brush body. The hair grooming brush device may thereby be utilized in a convenient manner as hereinbefore explained. The reflector element and grip handle element may then be pushed into the retracted positions in which they are latched.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hair grooming device, comprising a supporting body having at least one external mounting face, hair engaging elements projecting from said face of the body, grip means connected to the body, a reflector element, means movably and non-detachably mounting the reflector element in the body for displacement between positions retracted within the body and extended therefrom, and selectively actuated means for displacing the reflector element to the extended position, said grip means including a handle element, means movably mounting the handle element in the body for displacement between positions retracted within the body and extended therefrom, and means for displacing the handle element to the extended position simultaneously with the reflector element.

2. The combination of claim 1 wherein said means for displacing each of said elements includes a compression spring, and means anchoring the spring to the element for abutment by the body in the retracted position thereof.

3. The combination of claim 1 wherein said reflector and handle elements project from the body in perpendicular relation to each other in the extended positions thereof and in substantially parallel spaced relation to the mounting face of the body.

4. The combination of claim 1 including stop means mounted in the body for engagement by the reflector element in the extended position to prevent detachment thereof from the body.

5. The combination of claim 2 wherein said displacing means further includes latch means for holding the element in the retracted position under the bias of the spring, and manually displaceable release means engageable with the latch means for disengagement thereof from the element.

6. The combination of claim 5 wherein said manually displaceable release means includes a single release button displaceable to a release position against the bias of the latch means.

* * * * *